US008560303B2

(12) United States Patent
Beack et al.

(10) Patent No.: US 8,560,303 B2
(45) Date of Patent: Oct. 15, 2013

(54) APPARATUS AND METHOD FOR VISUALIZATION OF MULTICHANNEL AUDIO SIGNALS

(75) Inventors: Seung-Kwon Beack, Seoul (KR); Dae-Young Jang, Daejon (KR); Jeong-Il Seo, Daejon (KR); Kyeong-Ok Kang, Daejon (KR); Jin-Woo Hong, Daejon (KR); Jin-Woong Kim, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 1121 days.

(21) Appl. No.: 12/278,025

(22) PCT Filed: Feb. 5, 2007

(86) PCT No.: PCT/KR2007/000608

§ 371 (c)(1),
(2), (4) Date: Nov. 24, 2008

(87) PCT Pub. No.: WO2007/089129

PCT Pub. Date: Aug. 9, 2007

(65) Prior Publication Data

US 2009/0182564 A1 Jul. 16, 2009

Related U.S. Application Data

(60) Provisional application No. 60/787,000, filed on Mar. 29, 2006, provisional application No. 60/830,132, filed on Jul. 11, 2006, provisional application No. 60/831,856, filed on Jul. 19, 2006.

(30) Foreign Application Priority Data

Feb. 3, 2006 (KR) ..... 10-2006-0010559

(51) Int. Cl.
*G10L 25/00* (2013.01)

(52) U.S. Cl.
USPC ..... 704/200; 704/201; 704/200.1

(58) Field of Classification Search
USPC ..... 704/200–201, 500–501
See application file for complete search history.

(56) References Cited

U.S. PATENT DOCUMENTS 6,977,653 B1 * 12/2005 Cleary et al. ..... 345/440
7,546,213 B1 * 6/2009 Skovenborg et al. ..... 702/48

(Continued)

FOREIGN PATENT DOCUMENTS

KR 2005-0054639 A 6/2005
WO 2004/080125 A1 9/2004

OTHER PUBLICATIONS

J. Breebaart, et al; "MPEG Spatial Audio Coding/MPEG Surround: Overview and Current Status", AES 119$^{th}$ Convention, New York U.S.A., pp. 1-17, Oct. 7-10, 2005.
Han-gil Moon, et al; "A Multi-Channel Audio Compression Method with Virtual Source Location Information for MPEG-4 SAC", 2005 IEEE Transactions, vol. 51, Issue 4, pp. 1253-1259, Nov. 2005.
International Search Report, mailed Apr. 30, 2007; PCT/KR2007/000608.

(Continued)

*Primary Examiner* — Douglas Godbold
(74) *Attorney, Agent, or Firm* — Ladas & Parry LLP

(57) ABSTRACT

Provided are an apparatus and method for visualizing multichannel audio signals. The apparatus includes a spatial audio decoding unit for receiving a downmix signal of a time domain, converting the downmix signal into a signal of a frequency domain to output a frequency domain downmix signal, and synthesizing a multichannel audio signal based on the spatial parameter and the downmix signal; and a multichannel visualizing unit for creating visualization information of the multichannel audio signal based on the frequency domain downmix signal and the spatial parameter.

13 Claims, 4 Drawing Sheets

(56) References Cited

U.S. PATENT DOCUMENTS

| | | | | |
|---|---|---|---|---|
| 7,916,873 | B2 * | 3/2011 | Villemoes et al. | 381/22 |
| 7,983,922 | B2 * | 7/2011 | Neusinger et al. | 704/500 |
| 2004/0111171 | A1 | 6/2004 | Jang et al. | |
| 2005/0132397 | A1 | 6/2005 | Moon | |
| 2005/0275626 | A1 * | 12/2005 | Mueller et al. | 345/156 |
| 2006/0004583 | A1 * | 1/2006 | Herre et al. | 704/500 |
| 2006/0106620 | A1 * | 5/2006 | Thompson et al. | 704/500 |
| 2006/0247918 | A1 * | 11/2006 | Schmidt et al. | 704/200 |
| 2008/0002842 | A1 * | 1/2008 | Neusinger et al. | 381/119 |

OTHER PUBLICATIONS

Frank Baumgarte, et al; "Estimation of Auditory Spatial Cues for Binaural Cue Coding", 2002 IEEE International Conference on Acoustics, Speech, and Signal Processing (ICASSP), May 13-17, 2002, vol. 2; pp. II-1801-II-1804.

Audio Subgroup; "Text of Working Draft for Spatial Audio Coding (SAC)", International Organization for Standardization Organisation Internationale Normalisation ISO/IEC JTC 1/SC 29/WG 11 Coding of Moving Pictures and Audio, ISO/IEC JTC 1/SC 29/WG 11N7136, Apr. 2005, Busan, Korea, 132 pages.

* cited by examiner

APPARATUS AND METHOD FOR VISUALIZATION OF MULTICHANNEL AUDIO SIGNALS

TECHNICAL FIELD

The present invention relates to an apparatus and method for visualizing multichannel audio signals; and, more particularly, to an apparatus and method for visualizing multichannel audio signals in a multichannel audio decoding device based on Spatial Audio Coding (SAC).

BACKGROUND ART

Spatial Audio Coding (SAC) is a technology for efficiently compressing multichannel audio signals while maintaining compatibility with a conventional mono or stereo audio system. The SAC technology relates to a method for presenting multichannel signals or independent audio object signals as downmixed mono or stereo signal and side information, which is also called a spatial parameter, and transmitting and recovering the multichannel signals or independent audio object signals. The SAC technology can transmit a high-quality multichannel signal at a very low bit rate.

According to a main strategy of the SAC technology, a spatial parameter of each band is estimated by analyzing the multichannel signal according to each sub-band, and the multichannel original signal is recovered based on a spatial parameter and a downmix signal. Therefore, the spatial parameter plays an important role in recovering the original signal and becomes a primary factor controlling sound quality of the audio signal played by the SAC technology. Binaural cue coding (BCC) is currently introduced as a representative SAC technology. A spatial parameter according to the BCC includes inter-channel level difference (ICLD), inter-channel time difference (ICTD) and inter-channel coherence (ICC).

In Moving Picture Experts Group (MPEG), standardization of a technology for maintaining magnitude of multichannel audio signals and compressing the multichannel audio signals at a low bit rate while providing compatibility with a conventional stereo audio compression standard such as advanced audio coding (AAC) and MP3 has been progressed. To be specific, standardization of the SAC technology based on the BCC has been progressed under the title "MPEG Surround". Herein, channel level difference (CLD) as the same definition as the ICLD is used as a spatial parameter and only the ICC excluding the ICTD is additionally used.

The MPEG Surround is a parametric multichannel audio compression technology for presenting M audio signals based on side information including N audio signals (M>N) and spatial parameters where a human being determines a position of a sound source. An MPEG Surround encoder downmixes the multichannel audio signal into a mono or stereo channel, compresses the downmixed audio signal into a conventional MPEG-4 audio tool such as MPEG-4 AAC and MPEG-4 HE-AAC, extracts a spatial parameter from the multichannel audio signal, and multiflexes the spatial parameter with the encoded downmix audio signal. An MPEG Surround decoder separates the downmix audio signal from the spatial parameter by using a de-multiflexer and synthesizes the multichannel audio signal by applying the spatial parameter to the downmix audio signal.

A graphic equalizer using a frequency analyzer is mainly applied as a method for simultaneously listening and visualizing typical mono or stereo-based contents.

In case of multichannel, visualization by using only the graphic equalizer based on the frequency analyzer has a limitation in representing dynamic sound scene to a user. Also, the multichannel visualization method only applies the basic visualization method of the size of each channel signal. Although the multichannel audio signal can provide the position of diverse sound images on space, there is a problem that a position of the sound image created by the current multichannel signal is recognized and played as a unique thing by the decoder.

DISCLOSURE

Technical Problem

An embodiment of the present invention is directed to providing an apparatus and method for visualizing multichannel audio signals which can visually display dynamic sound scene based on a spatial parameter in a multichannel audio decoding device based on spatial audio coding.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided an apparatus for decoding multichannel audio signals based on a spatial parameter, including: a spatial audio decoding unit for receiving a downmix signal of a time domain, converting the downmix signal into a signal of a frequency domain to output a frequency domain downmix signal, and synthesizing a multichannel audio signal based on the spatial parameter and the downmix signal; and a multichannel visualizing unit for creating visualization information of the multichannel audio signal based on the frequency domain downmix signal and the spatial parameter.

In accordance with another aspect of the present invention, there is provided an apparatus for visualizing multichannel audio signals based on spatial audio coding (SAC), including: a relative channel gain estimator for computing and outputting a relative power gain value of channels based on a channel level difference (CLD) parameter; and a real channel gain estimator for receiving a downmix signal and the relative power gain value, and computing and outputting a real power gain value of the multichannel representing frequency response of channels based on the relative power gain value and power of the downmix signal.

In accordance with another aspect of the present invention, there is provided a method for visualizing multichannel audio signals based on spatial audio coding (SAC), including: a) receiving a channel level difference (CLD) parameter; b) computing a relative power gain value of channels based on the CLD parameter; c) receiving a downmix signal and the relative power gain value; and d) computing and outputting a real power gain value of multichannel representing frequency response of channels based on power of the relative power gain value and the downmix signal.

Advantageous Effects

The present invention can visually represent dynamic sound scene based on a spatial parameter in a multichannel audio decoding device based on spatial audio coding.

Also, the present invention can provide a realistic multichannel audio service to a user by visually representing dynamic sound scene.

BEST MODE FOR THE INVENTION

A multichannel audio signal encoding device receives N multichannel signals and divides the N multichannel signals according to a frequency band in an analysis filter bank. A quadrature mirror filter (QMF) is used to divide a frequency domain into sub-bands at low complexity.

The quadrature mirror filter can induce efficient encoding with its property compatible with a tool such as spectral band replication (SBR). Each sub-band going through the quadrature mirror filter is divided into sub-bands having an equal dividend structure based on a Nyquist filter bank and reformed to have a frequency disassembly capability similar to an auditory system of a human being. An entire structure including the quadrature mirror filter and the Nyquist filter bank is called a hybrid quadrature mirror filter.

A spatial parameter is optionally extracted by analyzing spatial characteristics related to space perception from sub-band signals. The spatial parameter includes a channel level difference (CLD) parameter, an interchannel correlation (ICC) parameter, and a channel prediction coefficients (CPC) parameter.

The CLD parameter denotes a level difference between two channels according to a time-frequency bin.

The ICC parameter denotes correlation between two channels according to the time-frequency bin.

The CPC parameter denotes a prediction coefficient of an input channel or a combination among input channels to an output channel or a combination among output channels.

The input signals go through a quadrature mirror filter synthesis bank after the downmixing process, are converted into downmix signals of a time domain, are multiflexed and transmitted with side information, which is encoding information of the spatial parameter.

The downmix signal is automatically created in an encoding device and has an optimized format for play according to a mono/stereo play or a matrix surround decoding device, e.g., Dolby Prologic. Also, when an artistic downmix signal created as a result of post-process for wireless transmission or created by a studio engineer is provided as a downmix signal of the encoding device, the encoding device optimizes multichannel recovery in the decoder by controlling a spatial parameter based on the provided downmix signal.

Figure 6:
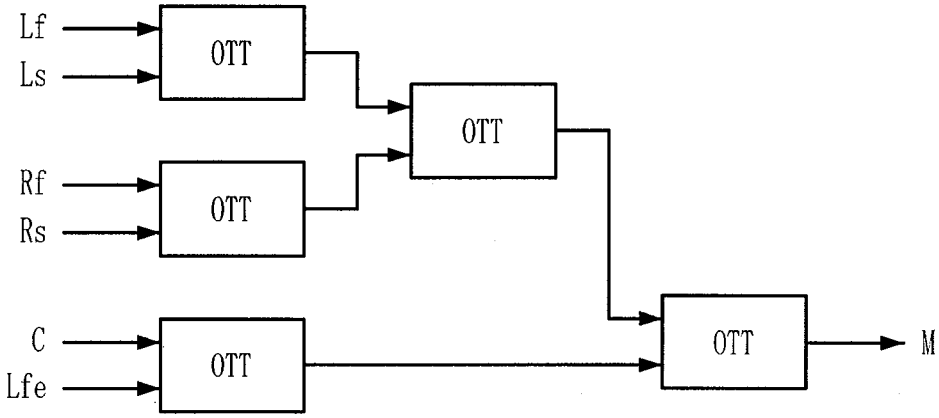
FIG. 6 shows a spatial parameter and downmix signal predicting procedure according to a 5152 mode in the MPEG Surround encoder.
Figure 7:
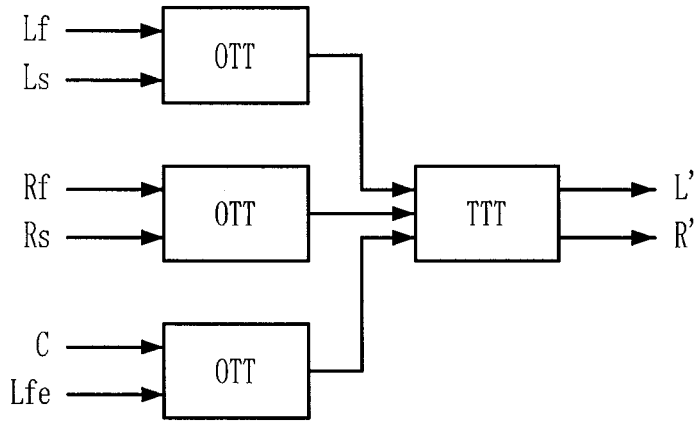
FIG. 7 shows a spatial parameter and downmix signal predicting procedure according to a 525 mode in the MPEG Surround encoder.
Figure 8:
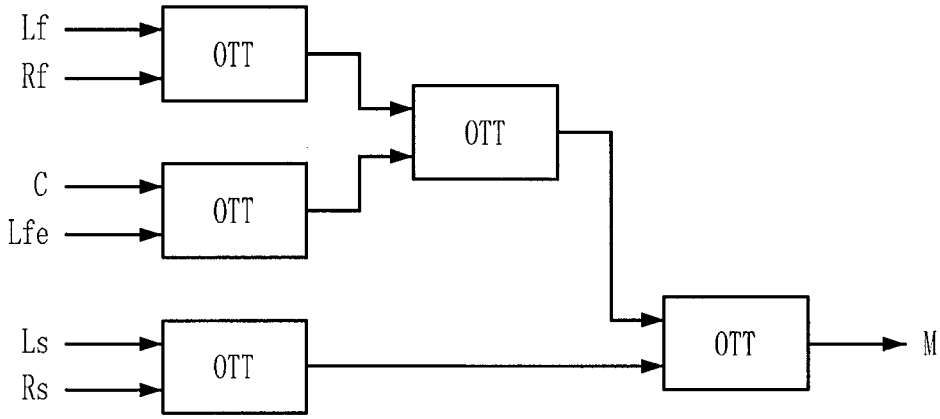
FIG. 8 shows a spatial parameter and downmix signal predicting procedure according to a 5151 mode in the MPEG Surround encoder.

The MPEG Surround encoder creates a mono or stereo downmix signal through an operation mode as shown in FIGS. 6 to 8.

FIG. 6 shows a spatial parameter and downmix signal predicting procedure according to a 5152 mode in the MPEG Surround encoder. FIG. 7 shows a spatial parameter and downmix signal predicting procedure according to a 525 mode in the MPEG Surround encoder.

FIG. 8 shows a spatial parameter and downmix signal predicting procedure according to a 5151 mode in the MPEG Surround encoder.

When a 5.1 channel signal is inputted and the downmix signal is a mono signal, the MPEG Surround encoder operates as the 5152 mode or the 5151 mode as shown in FIG. 6 or 8 and creates a mono downmix signal. When a 5.1 channel signal is inputted and the downmix signal is a stereo signal, the MPEG Surround encoder operates as the 525 mode as shown in FIG. 7 and creates a stereo downmix signal. The MPEG Surround encoder can operate as a Two-To-Three (TTT) energy mode or as a TTT prediction mode according to the usage of the CPC parameter in the 525 mode.

The 5152 mode and the 5151 mode have a difference in an order of analyzing the inputted multichannel audio signals, and creating a spatial parameter and a mono downmix signal as shown in FIGS. 8 and 6, respectively.

Figure 1:
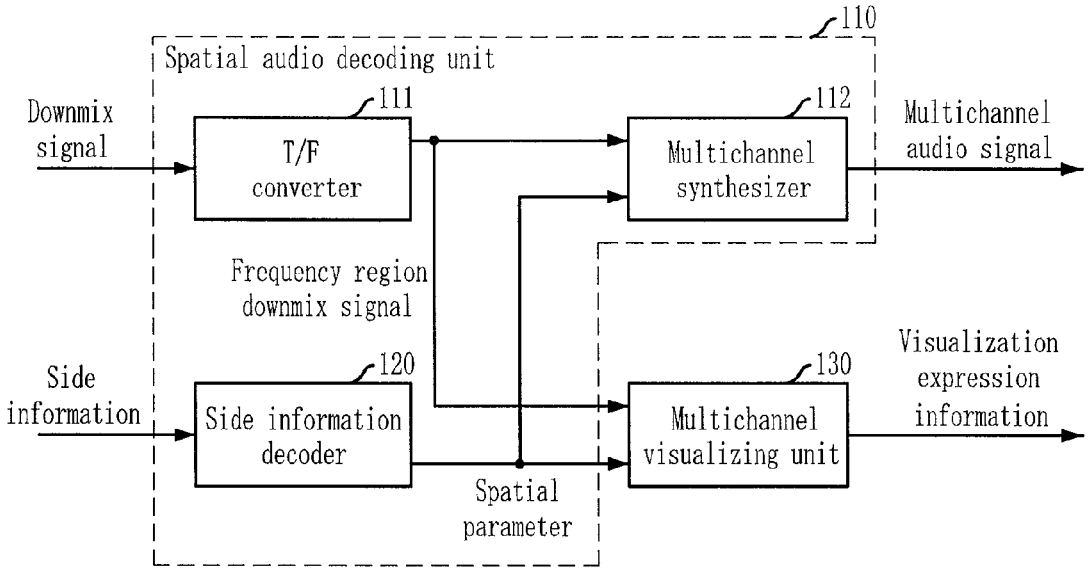
FIG. 1 is a block diagram showing a multichannel audio signal decoding device based on spatial audio coding in accordance with an embodiment of the present invention.

FIG. 1 is a block diagram showing a multichannel audio signal decoding device based on spatial audio coding in accordance with an embodiment of the present invention.

As shown in FIG. 1, the multichannel audio signal decoding device includes a spatial audio decoding unit 110, which includes a T/F converter 111, a side information decoder 120 and a multichannel synthesizer 112, and a multichannel visualizing unit 130.

The T/F converter 111 converts a downmix signal of inputted time domain and outputs a downmix signal of a frequency domain.

The side information decoder 120 receives and decodes side information, and outputs a spatial parameter. To be specific, the side information decoder 120 receives a bit stream of the side information and performs an entropy decoding process. A Huffman coding method is generally adopted as the entropy decoding method.

The multichannel synthesizer 112 receives the downmix signal of the frequency domain and the spatial parameter and synthesizes and outputs a multichannel audio signal based on the downmix signal and the spatial parameter.

The spatial parameter, which is decoded side information, includes a channel level difference (CLD) parameter, an interchannel correlation (ICC) parameter, and channel prediction coefficients (CPC) parameter. A signal creating procedure in the multichannel synthesizer 112 may differ according to the SAC method.

The multichannel visualizing unit 130 receives the downmix signal of the frequency domain and the spatial parameter, creates and outputs visualization information for visually representing an image of multichannel sound based on the downmix signal and the spatial parameter. The spatial parameters have relative power information between two channels or among three channels at a specific parameter band or a frequency time lattice. Therefore, power of the downmix signal is additionally used to exactly represent an actual power level of an object to be visualized, e.g., a channel, a band and a sound source.

The visualization information includes power level information of each channel, frequency information of the channel, and position/power level information of virtual sound source.

The power level information of the channel represents an entire power level of each channel, i.e., channel volume, which forms the multichannel audio signal. The information can be used to predict channel volume.

A frequency response of the channel represents a power level at each frequency/time lattice of the multichannel output signal on a dB basis. The visualization output represents what similar to the output of the graphic equalizer of a general stereo audio player and can represent frequency response of all channels forming the multichannel audio signal.

The position/power level information of the virtual sound source represents the position and the power level of the related virtual sound source at each frequency/time lattice. The position of the virtual sound source is predicted between/among adjacent channels based on the Constant Power Panning (CPP) Law. Therefore, the visualization output can dynamically represent a multichannel sound image by representing the position and size of the multichannel sound image every moment.

Figure 2:
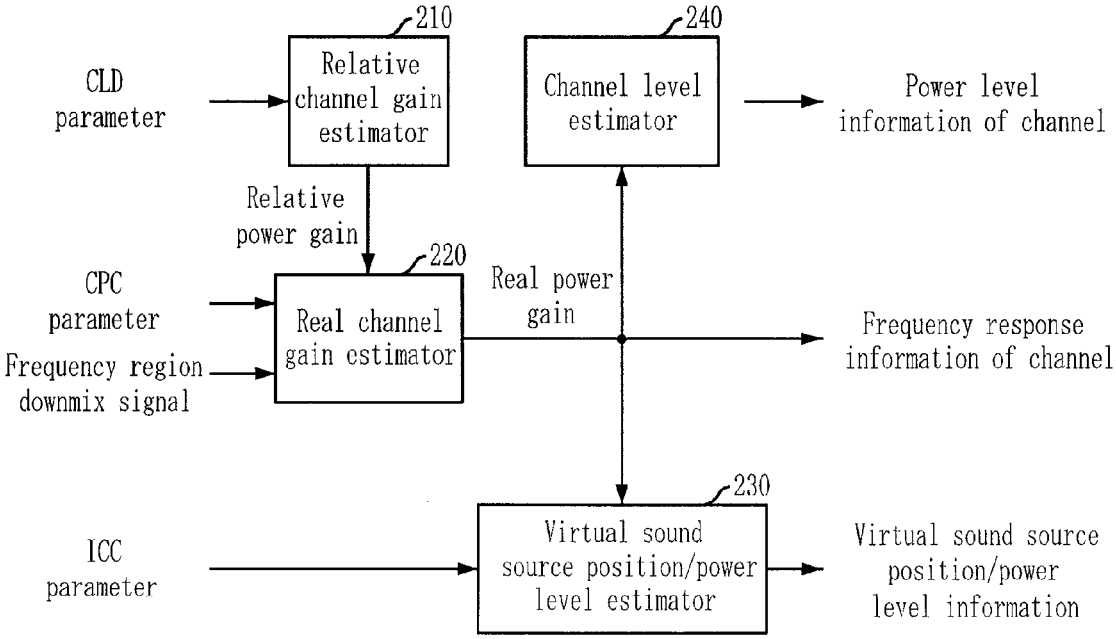
FIG. 2 is a block diagram illustrating the multichannel visualizing unit in accordance with an embodiment of the present invention.

FIG. 2 is a block diagram illustrating the multichannel visualizing unit in accordance with the embodiment of the present invention.

As shown in FIG. 2, the multichannel visualizing unit includes a relative channel gain estimator 210, a real channel gain estimator 220, a channel level estimator 240 and a virtual sound source position/power level estimator 230.

The relative channel gain estimator 210 computes and outputs a relative power gain value of a channel in a parameter band based on the CLD parameter.

A procedure for computing a relative power gain value of channels based on the CLD parameter will be described for a case that the downmix signal is a mono signal and a case that the downmix signal is a stereo signal.

When the downmix signal is a mono signal, the gain value of two channels according to the One-To-Two (OTT) mode is computed from a CLD parameter value based on Equation 1.

$$G_{l,m}^{Clfe} = \frac{1}{\sqrt{1 + 10^{D_{CLD}^{Q}(0,l,m)/10}}} \qquad \text{Eq. 1}$$

$$G_{l,m}^{LR} = G_{l,m}^{Clfe} \cdot 10^{D_{CLD}^{Q}(0,l,m)/20}$$

where, m is an index of a parameter band and 1 is an index of a parameter set. When l=1, a gain value is computed by selecting one from the parameter set.

When a downmix is a mono signal according to the 5152 mode, a relative power gain value of each channel in the multichannel is computed as multiplication of gain values of the channel computed based on the CLD parameter, which is shown in Equation 2 below.

$$pG_{l,m}^{Lf} = G_{l,m}^{L} \cdot G_{l,m}^{Lf}, \qquad \text{Eq. 2}$$

$$pG_{l,m}^{Ls} = G_{l,m}^{L} \cdot G_{l,m}^{Ls},$$

-continued $$pG_{l,m}^{Rf} = G_{l,m}^{R} \cdot G_{l,m}^{Rf},$$

$$pG_{l,m}^{C} = G_{l,m}^{Clfe},$$

$$pG_{l,m}^{lfe} = 0(m > 1)$$

$$pG_{l,m}^{Rs} = G_{l,m}^{R} \cdot G_{l,m}^{Rs}$$

and $$pG_{l,m}^{lfe} = G_{l,m}^{Clfe} \cdot G_{l,m}^{lfe},$$

$$pG_{l,m}^{C} = G_{l,m}^{Clfe} \cdot G_{l,m}^{C}(m = 0, 1)$$

Signals expressed as Clfe or LR denote summation signals created from two input signals according to the OTT mode. The Clfe denotes a summation signal computed from a center channel and the LFE channel. The LR denotes a summation signal computed from a left channel signal and a right channel signal. Herein, the left channel signal is a summation signal of an Lf channel and an Ls channel, and the right channel is a summation signal of an Rf channel and an Rs channel.

When the downmix signal is a stereo signal according to the 525 mode, a gain value of a channel is computed according to Two-To-Three (TTT) mode based on Equation 3 and a relative power gain value of each channel in the multichannel is computed.

$$G_{l,m}^{Clfe} = \frac{1}{\sqrt{1 + 10^{D_{CLD_1}^{Q}(0,l,m)/10}}} \qquad \text{Eq. 3}$$

and $$G_{l,m}^{LR} = G_{l,m}^{Clfe} \cdot 10^{D_{CLD_2}^{Q}(0,l,m)/20}$$

$$G_{l,m}^{R} = \frac{G_{0,l,m}^{LR}}{\sqrt{1 + 10^{D_{CLD_1}^{Q}(0,l,m)/10}}}$$

and $$G_{l,m}^{L} = G_{l,m}^{LR} \cdot G_{l,m}^{R} \cdot 10^{D_{CLD_2}^{Q}(0,l,m)/20}$$

The real channel gain estimator 220 receives the relative power gain value and the downmix signal of the frequency domain, computes and outputs a real power gain value of each channel and each band in the multichannel representing a frequency response of the channel.

Operations of the real channel gain estimator 220 will be respectively described in detail hereinafter according to when the downmix signal is a mono signal and when the downmix signal is a stereo signal.

When the downmix signal is the mono signal according to the 5152 mode, a real power gain value of each channel and each band in the multichannel is computed based on the relative power gain value and power of the downmix signal according to Equation 4 below.

$$rpG_{l,m}^{Lf} = pG_{l,m}^{Lf} \cdot pDMX_m^{mono}, rpG_{l,m}^{Ls} = pG_{l,m}^{Ls} \cdot pDMX_m^{mono},$$

$$rpG_{l,m}^{Rf} = pG_{l,m}^{Rf} \cdot pDMX_m^{mono}, rpG_{l,m}^{Rs} = pG_{l,m}^{Rs} \cdot pDMX_m^{mono} \text{ and}$$

$$rpG_{l,m}^{C} = pG_{l,m}^{C} \cdot pDMX_m^{mono}, rpG_{l,m}^{lfe} = 0(m>1)$$

$$rpG_{l,m}^{lfe} = pG_{l,m}^{lfe} \cdot pDMX_m^{mono}, rpG_{l,m}^{C} = pG_{l,m}^{C} \cdot pDMX_m^{mono}(m=0,1) \qquad \text{Eq. 4}$$

where $pDMX_m^{mono}$ is power of a downmix mono signal of an $m^{th}$ parameter band.

When the downmix signal is a stereo signal according to the TTT prediction mode of the 525 mode, a real power gain value of each channel and each band is computed based on the CPC parameter, power of the downmix signal and Equation 5 below.

$$rpG_{l,m}^{L} = \frac{1}{3}\left\{\begin{array}{l}(D_{CPC_1}^{Q}(0, l, m) + 2)pDMX_m^{left} + \\ (D_{CPC_2}^{Q}(0, l, m) - 1)pDMX_m^{Right}\end{array}\right\} \quad \text{Eq. 5}$$

$$rpG_{l,m}^{R} = \frac{1}{3}\left\{\begin{array}{l}(D_{CPC_1}^{Q}(0, l, m) - 1)pDMX_m^{left} + \\ (D_{CPC_2}^{Q}(0, l, m) + 2)pDMX_m^{Right}\end{array}\right\}$$

$$rpG_{l,m}^{L} = \frac{1}{3}\left\{\begin{array}{l}(1 - D_{CPC_1}^{Q}(0, l, m))pDMX_m^{left} + \\ (1 - D_{CPC_2}^{Q}(0, l, m))pDMX_m^{Right}\end{array}\right\}$$

The channel level estimator 240 receives the actual power gain value of each channel and each band, computes and outputs a power level of the channel. The power level of the channel representing entire power level of each channel is computed as a summation of the real power gain values in all parameter bands according to Equation 6.

$$L^{L} = \sum_{l}\sum_{m} rpG_{l,m}^{L}, \quad \text{Eq. 6}$$

$$L^{R} = \sum_{l}\sum_{m} rpG_{l,m}^{R},$$

$$L^{Ls} = \sum_{l}\sum_{m} rpG_{l,m}^{Ls},$$

$$L^{Rs} = \sum_{l}\sum_{m} rpG_{l,m}^{Rs},$$

$$L^{C} = \sum_{l}\sum_{m} rpG_{l,m}^{C},$$

$$L^{Lfe} = \sum_{l}\sum_{m} rpG_{l,m}^{Lfe}$$

The virtual sound source position and power level estimator 230 receives the real power gain value and the ICC parameter of each channel and each band, computes and outputs virtual sound source position information and power level information based on the power gain value of the real channel and fixed multichannel output layout according to Equations 7 and 8.

An output channel vector of each channel is computed according to Equation 7 below.

$$CV_c = rpG_{l,m}^{C}(\cos(0) + i\sin(0))$$

$$CV_{Lf} = rpG_{l,m}^{Lf}(\cos(-30) + i\sin(-30))$$

$$CV_{Rf} = rpG_{l,m}^{Rf}(\cos(30) + i\sin(30))$$

$$CV_{Ls} = rpG_{l,m}^{Ls}(\cos(-110) + i\sin(-110))$$

$$CV_{Rs} = rpG_{l,m}^{Rs}(\cos(110) + i\sin(11)) \quad \text{Eq. 7}$$

In the MPEG Surround encoder to which the present embodiment is applied, the multichannel output configuration is fixed such as the 5.1 channel configuration. Therefore, output channel vectors are computed according to an output configuration angle determined in an encoder as shown in Equation 7. Also, power of each channel vector is determined according to the real power gain value of each channel computed in the real channel gain estimator 220. Since the LFE channel does not affect determining the position of the virtual sound source, the LFE channel is not considered in the present embodiment.

A virtual sound source position vector is computed as a summation of adjacent two channel vectors according to Equation 8 below. Herein, the virtual sound source position vector has a complex number format.

$$VS_1 = CV_C/\sqrt{2} + CV_{Lf}, VS_2 = CV_{Lf} + CV_{Ls}, VS_3\ CV_{Ls} + CV_{Rs}$$

$$VS_4 = CV_{Rs} + CV_{Rf}, VS_5 = CV_{Rf} + CV_C/\sqrt{2} \quad \text{Eq. 8}$$

The virtual sound source position and power level are directly computed from the virtual sound source position vector. Azimuth angle and power of the virtual sound source vector are substituted for the position and the power level of the virtual sound source in order to visually represent the virtual sound source vector. An ICC parameter value is optionally used to represent a dominant virtual sound source vector. The ICC parameter value can be used to efficiently represent a sound image of surround sound by using diverse constraints.

Figure 3:
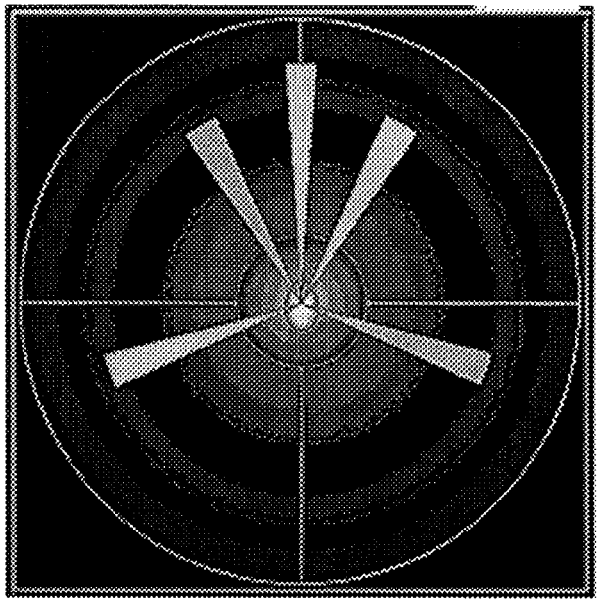
FIG. 3 shows a multichannel visualization screen representing the power level of channels in accordance with an embodiment of the present invention.

FIG. 3 shows a multichannel visualization screen representing the power level of the channel in accordance with an embodiment of the present invention.

As shown in FIG. 3, a length of stick in each channel shows a sound volume level of the channel. The user can figure out through the visualization screen that the power level of the center channel is larger than the power level of the left and right channels.

Figure 4:
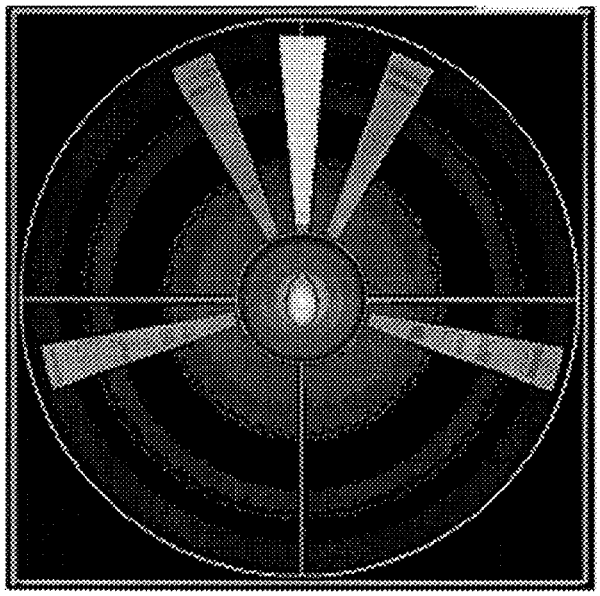
FIG. 4 shows a multichannel graphic visualization screen representing a frequency response of a channel in accordance with the embodiment of the present invention.

FIG. 4 shows a multichannel graphic visualization screen representing frequency response of the channel in accordance with the embodiment of the present invention.

As shown in FIG. 4, frequency response of channels can be represented based on difference among colors.

The user can observe through the visualization screen that the magnitude of the center channel is smaller than those of the other channels. Also, the user can observe the power level of each sub-band of each channel on visualization screen.

Figure 5:
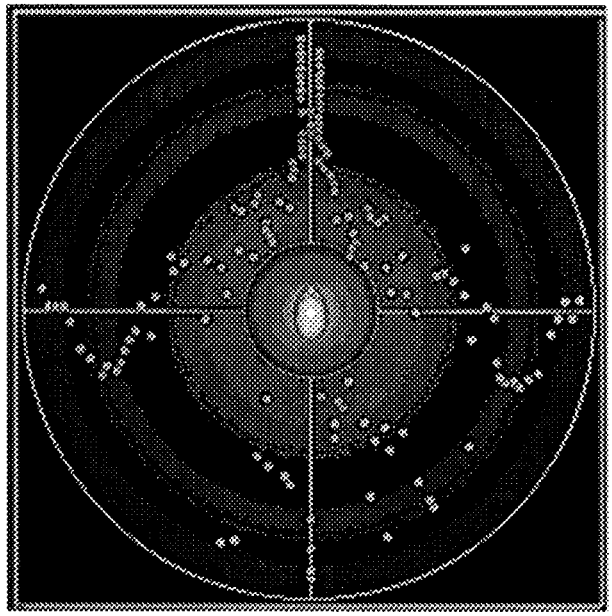
FIG. 5 is a multichannel visualization screen representing a virtual sound source position and power level in accordance with an embodiment of the present invention.

FIG. 5 is a multichannel visualization screen representing a virtual sound source position and power level in accordance with the embodiment of the present invention.

As shown in FIG. 5, the virtual sound source position and power level can be visualized from the azimuth angle and power of the computed virtual sound source vector. The user can observe through the visualization screen that a virtual sound source is concentrated around the center channel at a remarkably large power level.

The technology of the present invention as described above can be realized as a program and stored in a computer-readable recording medium, such as CD-ROM, RAM, ROM, floppy disk, hard disk and magneto-optical disk. Since the process can be easily implemented by those skilled in the art of the present invention, further description will not be provided herein.

While the present invention has been described with respect to certain preferred embodiments, it will be apparent to those skilled in the art that various changes and modifications may be made without departing from the scope of the invention as defined in the following claims.

INDUSTRIAL APPLICABILITY

The present invention is used to the apparatus for visualizing multichannel audio signals.

What is claimed is:

1. An apparatus for decoding multichannel audio signals based on a spatial parameter, comprising:

a spatial audio decoding unit for receiving a downmix signal of a time domain, converting the downmix signal into a signal of a frequency domain to output a frequency domain downmix signal, and synthesizing a multichannel audio signal based on the spatial parameter and the downmix signal; and a multichannel visualizing unit for creating visualization information of each sub-band in the multichannel audio signal based on the frequency domain downmix signal and the spatial parameter, wherein the spatial parameter is transmitted from a spatial audio coding (SAC) based encoder, includes information of each sub-band in the multichannel audio signal, and is inputted into the multichannel visualizing unit.

2. The decoding apparatus of claim 1, wherein the spatial parameter includes at least one among a channel level difference (CLD) parameter, a channel prediction coefficients (CPC) parameter, and an interchannel correlation (ICC) parameter.

3. The decoding apparatus of claim 1, wherein the multichannel visualizing unit includes:

a relative channel gain estimator for receiving a CLD parameter, and computing and outputting a relative power gain value of channels based on the CLD parameter; and a real channel gain estimator for receiving the relative power gain value and the downmix signal of the frequency domain, and computing and outputting a real power gain value of the multichannel representing a frequency response of the channels based on the relative power gain value and power of the downmix signal.

4. The decoding apparatus of claim 3, wherein when the downmix signal is a stereo signal, the real channel gain estimator computes and outputs the real power gain value of the multichannel based on a CPC parameter.

5. The decoding apparatus of claim 3, wherein the multichannel visualizing unit further includes a channel level estimator for receiving a real power gain value of the multichannel, and computing and outputting the power level of the channel.

6. The decoding apparatus of claim 3, wherein the multichannel visualizing unit further includes a virtual sound source position estimator for receiving the real power gain value of the multichannel, and computing and outputting virtual sound source position and power level information based on the real power gain value and a predetermined multichannel output configuration angle.

7. The decoding apparatus of claim 6, wherein the virtual sound source position estimator adopts an ICC parameter to represent a dominant virtual sound source vector.

8. The decoding apparatus of claim 1, wherein the visualization information includes power level information of channels, frequency response information of channels, and virtual sound source position and power level information of channels.

9. An apparatus for visualizing multichannel audio signals based on spatial audio coding (SAC), comprising:

a relative channel gain estimator for computing and outputting a relative power gain value of each sub-band in the multichannel audio signal based on a channel level difference (CLD) parameter;

a real channel gain estimator for receiving a downmix signal and the relative power gain value, and computing and outputting a real power gain value of each sub-band in the multichannel audio signal representing frequency response of each sub-band in the multichannel audio signal based on the relative power gain value and power of the downmix signal; and a virtual sound source position estimator for receiving the real power gain value of each sub-band in the multichannel audio signal, and computing and outputting virtual sound source position and power level information based on the real power gain value of each sub-band in the multichannel audio signal and a predetermined multichannel output configuration angle, wherein the channel level difference (CLD) parameter is transmitted from a spatial audio coding (SAC) based encoder, includes information of each sub-band in the multichannel audio signal, and is inputted into the apparatus for visualizing multichannel audio signals.

10. The apparatus of claim 9, wherein when the downmix signal is a stereo signal, the real channel gain estimator computes and outputs the real power gain value of the multichannel based on a channel prediction coefficients (CPC) parameter.

11. The apparatus of claim 9, wherein the multichannel visualizing unit further includes a channel level estimator for receiving the real power gain value of the multichannel, and computing and outputting the power level of the channel.

12. A method for visualizing multichannel audio signals based on spatial audio coding (SAC), comprising:

a) receiving a channel level difference (CLD) parameter;

b) computing a relative power gain value of each sub-band in the multichannel audio signal based on the CLD parameter;

c) receiving a downmix signal and the relative power gain value;

d) computing and outputting a real power gain value of each sub-band in the multichannel audio signal multichannel representing frequency response of each sub-band in the multichannel audio signal based on power of the relative power gain value and the downmix signal; and computing and outputting virtual sound source position and power level information based on the real power gain value of each sub-band in the multichannel audio signal and a predetermined multichannel output configuration angle, wherein the channel level difference (CLD) parameter is generated by a spatial audio coding (SAC) based encoder, includes information of each sub-band in the multichannel audio signal, and is used for visualizing the multichannel audio signals.

13. The method of claim 12, further comprising:

e) computing and outputting a power level of a channel based on the real power gain value of the multichannel.

* * * * *